US005829432A

United States Patent [19]

Semeia

[11] Patent Number: 5,829,432

[45] Date of Patent: Nov. 3, 1998

[54] REGULATOR FOR UNDERWATER BREATHING APPARATUS

[75] Inventor: Roberto Semeia, Genova, Italy

[73] Assignee: Scubapro Europe S.r.L., Genova, Italy

[21] Appl. No.: 729,940

[22] Filed: Oct. 15, 1996

Related U.S. Application Data

[63] Continuation of Ser. No. 456,182, May 31, 1995, abandoned.

[30] Foreign Application Priority Data

Jan. 12, 1995 [IT] Italy ..... MI950050

[51] Int. Cl.[6] ..... B63C 11/02

[52] U.S. Cl. ..... 128/201.27; 128/201.28; 128/206.29

[58] Field of Search ..... 128/201.27, 201.28, 128/204.26, 206.29; 24/270, 271, 273

[56] References Cited

U.S. PATENT DOCUMENTS

| | | | |
|---|---|---|---|
| 1,646,463 | 10/1927 | Stokesberry | 24/273 |
| 2,018,906 | 10/1935 | Winter | 24/271 |
| 4,272,871 | 6/1981 | Weinhold | 24/273 |
| 4,650,221 | 3/1987 | Caillouet, Jr. | 24/271 |
| 5,048,519 | 9/1991 | Kasama et al. | 128/206.9 |

FOREIGN PATENT DOCUMENTS 0 307 314 3/1989 European Pat. Off. .

*Primary Examiner*—Aaron J. Lewis
*Attorney, Agent, or Firm*—Ostrolenk, Faber, Gerb & Soffen, L.L.P.

[57] ABSTRACT

A regulator (2) for underwater breathing apparatus (1) which guarantees a high degree of hygiene comprises a body (7), a delivery outlet (8) formed in the said body (7) to deliver a breathable mixture to a user, a mouthpiece (9) for the said delivery outlet (8) and quick-release fixing means (12) for the said mouthpiece (9) on the said delivery outlet (8).

10 Claims, 2 Drawing Sheets

REGULATOR FOR UNDERWATER BREATHING APPARATUS

This application is a continuation of application Ser. No. 08/456,182, filed May 31, 1995, now abandoned.

BACKGROUND OF THE INVENTION

1. Field of the Invention

The present invention relates to a regulator for underwater breathing apparatus, of the type comprising a body, a delivery outlet formed in the said body for delivery of breathable mixture to a user, and a mouthpiece for the said delivery outlet.

2. Description of the Prior Art

Delivery valves of the type considered have a mouthpiece mechanically force fitted onto the said delivery outlet in an irreversible manner to form the water tight seal between the mouthpiece and the delivery outlet and in order to be able to resist tension up to a predetermined safety value.

In specialised underwater activity schools or in distant tourist centres it is usual to hire underwater breathing apparatus and associated regulators to each user.

In such cases it has been widely accepted until now that the users using the previously hired regulators had to use mouthpieces which preceding users had held in their mouth without therefore any adequate guarantee of hygiene.

SUMMARY OF THE INVENTION

The technical problem on which the present invention is based is that of devising an underwater breathing apparatus regulator which has structural and functional characteristics such as to overcome the said disadvantage.

This problem is resolved by a regulator of a specific type which is characterised by the fact that it includes means for quick-release fixing of the said mouthpiece onto the said delivery outlet.

The principal advantage of the regulator according to the invention is due to the fact that it has an easily and quickly replaceable mouthpiece which is therefore personal, and which has an adequate guarantee of hygiene.

Further characteristics and advantages of the regulator according to the present invention will become apparent from the description of a preferred embodiment, given herein by way of indicative and non-limitative example, with reference to the attached drawings.

DESCRIPTION OF THE PREFERRED EMBODIMENT

Figure 1:
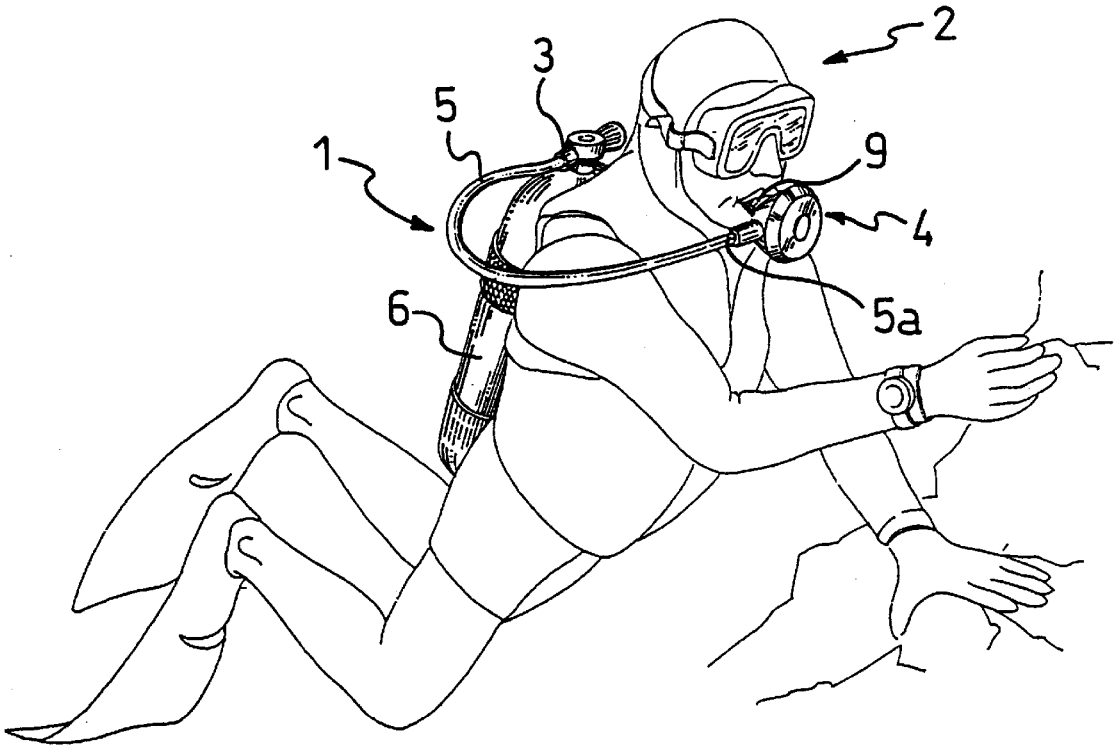
FIG. 1 shows underwater breathing apparatus which incorporates a regulator according to the invention, worn by a diver.

In the drawings underwater breathing apparatus of the type delivering a breathable mixture, for example air, is generally indicated 1, shown worn by a diver.

The breathing apparatus 1 has a regulator 2 which comprises a first stage 3 a second stage 4, a duct 5 which connects the first stage 3 and the second stage 4 and a pressure bottle 6 on which the first stage 3 is directly fitted.

The first stage 3 has the function of providing air to the second stage 4 via the duct 5 at a pressure intermediate between the storage pressure in the bottle 6 and the breathing pressure.

The regulator 2 includes a body 7 which defines the said second stage 4, into which leads one end 5A of the said duct 5 opens for the delivery of air.

Figure 2:
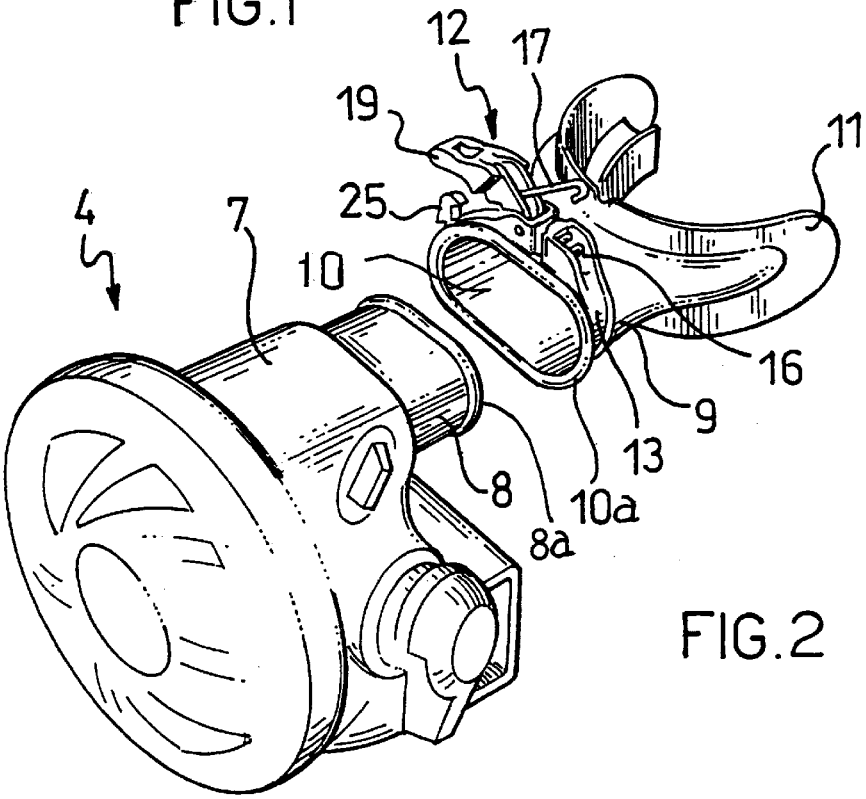
FIG. 2 is a perspective, partially exploded view of the regulator of FIG. 1, limited to its second stage.
Figure 4:
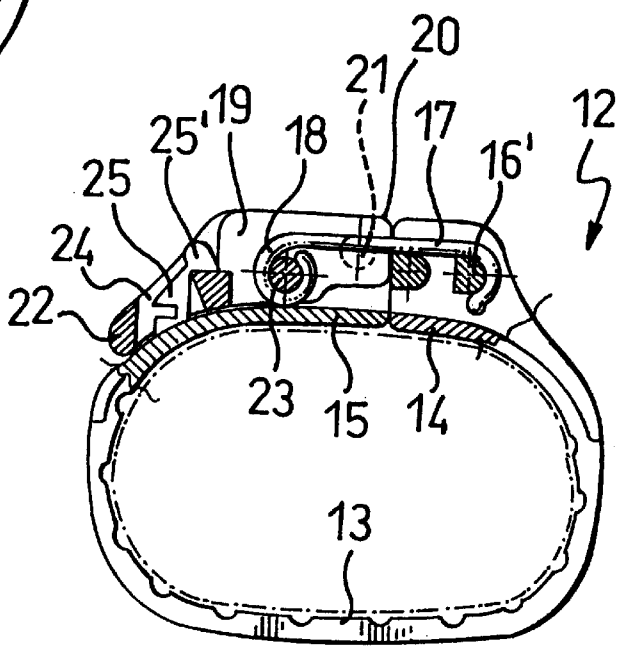
FIGS. 4 and 5 are partially sectioned plan views of the detail of FIG. 3 in different closure positions.
Figure 5:
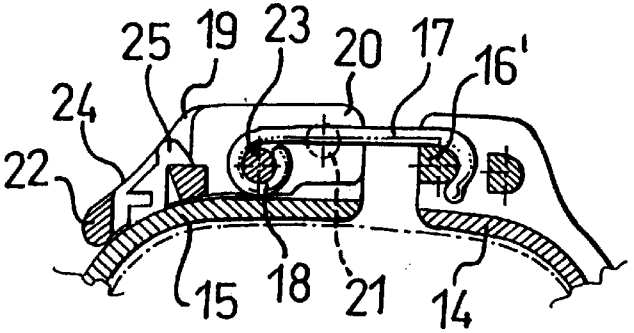
Figure 3:
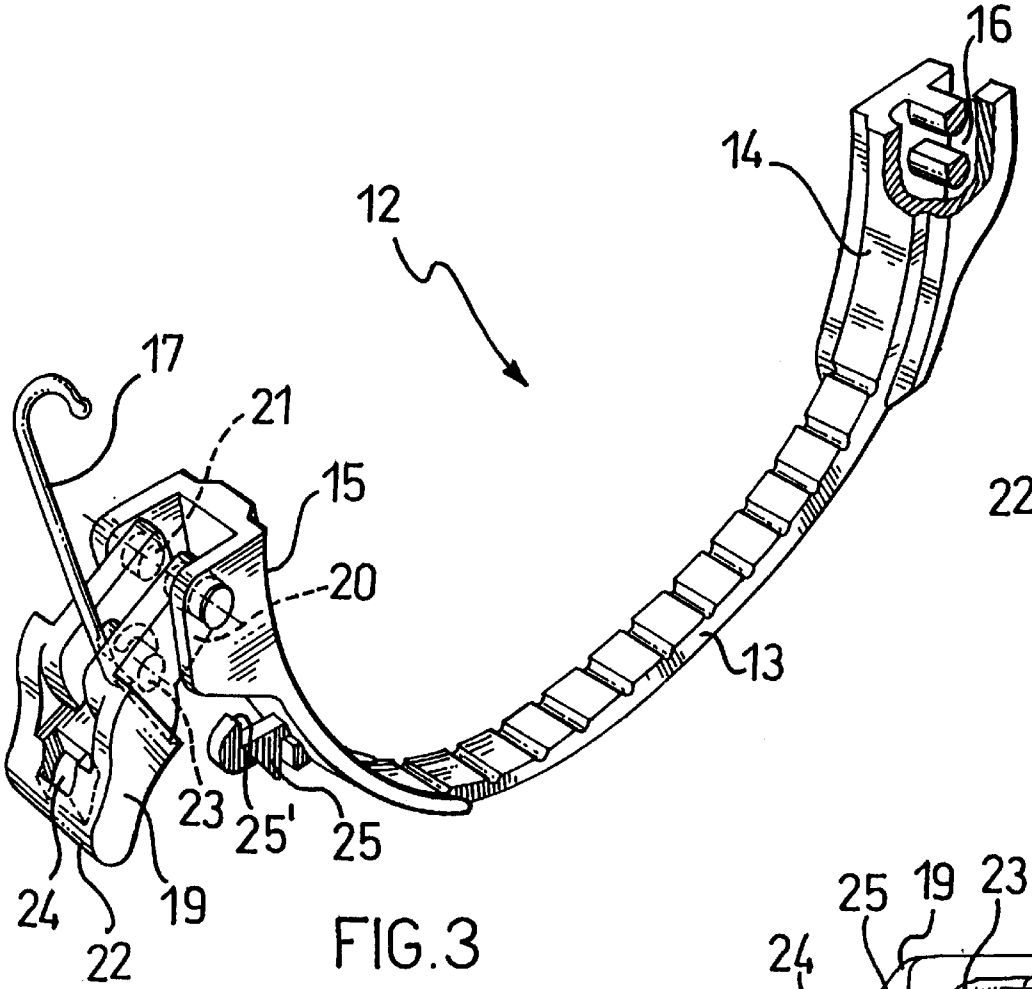
FIG. 3 is a partially sectioned perspective view of a detail of the regulator of FIG. 1.

The regulator 2 further includes a delivery outlet 8 formed in the said body 7 for the delivery of air to a user, in this example the diver who wears the breathing apparatus 1, and a mouthpiece 9 for the said delivery outlet 8. As shown in FIG. 2 the delivery outlet 8 comprises an annular ridge 8*a*, formed on an edge of the delivery outlet tube 8.

The mouthpiece 9, generally of silicone based or plastics material has a fixing portion 10 intended to be fitted onto the said delivery outlet 8, and a bite structure 11, which the user clamps in his mouth during underwater immersion. As shown in FIG. 2 the fixing portion 10 of the mouthpiece 9 comprises an annular ridge 10*a* formed on an edge of the fixing portion 10. The fixing portion or inlet tube 10 of the mouth piece made of silicone is inherently elastically deformable.

The regulator 2 according to the invention further includes quick-release fixing means 12 for the said mouthpiece 9 on the said delivery outlet.

According to this preferred embodiment the quick-release fixing means 12 comprise a band 13 which has opposite ends 14, 15.

On the end 14 the band has at least one pin 16. In the preferred embodiment the band 14 has two pins 16 disposed transversely of the band 13 and suitably spaced in such a way as to constitute an engagement point.

On the opposite end 15 the band 13 has a hook 17, preferably of stainless steel, intended to engage on the said at least one pin 16.

The hook 17 has a loop end 18 by means of which it is pivoted onto a lever 19, in turn rotatably connected to the band 13, the said lever 19 being movable between a closure position and an open position.

To this end the lever 19 is pivoted on its end 20 to the band 13 by means of a pivot 21. the lever 19 further has an opposite free end 22 and an intermediate pin 23 on which the loop end 18 of the said hook 17 is rotatably engaged.

In the free end 22 of the lever 9 is formed a through hole 24. In correspondence with the said hole 24 there is provided on the band 13 a hook 25 disposed rearwardly of the said lever 19, to retain the said lever 19 in the closure position.

The hook 25 is integrally formed with the said band 13 and is made of elastically deformably material.

The hook 15 has a head 25' which constitutes a manipulation point for the release of the free end 22 of the hook 25.

The operation of the regulator 2 according to the invention will be described hereinafter.

The mouthpiece 9 is fitted onto the delivery outlet 8 of the second stage 4 of the delivery valve 2 in order to overlap a predetermined portion of the delivery outlet tube 8 with the fixing portion inlet tube 10 of the mouthpiece 9. In order to give the connection the necessary water tightness and resistance to tension the band 13 is disposed about the fixing portion 10 and the hook 17 is placed in engagement on one of the pins 16 depending on the relative dimensions of the deliver outlet 8 and the removable mouthpiece 9.

In order to do this it is necessary to rotate the lever 19 to separate its free end 22 from the hook 25.

Once hooking is effected the lever 19 is rotated in the opposite direction to reach the closure position in which the hook 25 is engaged within the through hole 24. The band 13 is positioned on the axially extending area between the annular ridge 10*a* of the mouthpiece fixing portion 10 and the annular ridge 8*a* of the delivery outlet tube 8, in order to prevent the band 13 from slipping off the mouth piece tube 10*a* and the mouthpiece tube 10*a* together with the band 13 from slipping off the delivery outlet tube 8.

To remove the mouthpiece 9 from the delivery outlet 8 it is sufficient to act on the head 25' of the hook 25 with a finger or a pointed object, deforming the hook 25 until the free end 22 is released. At this point the lever is turned to separate the said end 22 from the hook 25 until reaching the open position in which the hook 17 is no longer in engagement with the pin 16.

As well as the above-mentioned advantage the regulator for underwater breathing apparatus according to the invention prevents accidental opening of the quick-release fixing means.

The mouthpiece lends itself to being produced in an assortment of different sizes materials and shapes to be sold separately from the underwater breathing apparatus regulators.

Moreover, the hook, which is subjected to mechanical fatigue, is resistant to saline aggressive agents being made of stainless steel.

Furthermore, the fabrication of the invention is easy and economic and it can be readily used even by untrained users.

The regulator described above can have introduced thereto numerous modifications and variations by one skilled in the art in order to satisfy particular requirements, all, however, lying within the ambit of protection of the invention as defined in the following claims.

I claim:

1. A regulator for an underwater breathing apparatus comprising:

a body having a outlet tube for delivering a breathable mixture to a user;

a replaceable mouthpiece having an inlet tube, said inlet and outlet tubes each having a central axis and a terminal end with an annular ridge on said end extending transversely of said central axis;

said outlet tube adapted to axially receive said inlet tube, one into the other such that their annular ridges are axially spaced apart a predetermined distance, and a quick release fixing means for tightly fixing said inlet tube to said outlet tube by engaging at least one of said tubes in the axially extending area between said annular ridges, said quick release fixing means permitting said inlet and outlet tubes to be easily released from each other.

2. A regulator (2) according to claim 1, wherein the said quick-release fixing means (12) comprise a band (13) which has at one end (14) at least one pin (16) and, at its opposite end (15), a hook (17) intended to engage on the at least one pin (16) and mounted on a lever (19) pivoted to the band (13), the said lever (19) being movable between a closure position and an open position.

3. A regulator (2) according to claim 2, wherein the said lever (19) has a free end (22) in which is formed a through hole (24), there being provided a hook (25) disposed rearwardly of the lever (19) on the band (13) to retain the lever (19) in the closure position.

4. A regulator (2) according to claim 3, wherein the said hook (25) is formed integrally with the band (13) and is made of elastically deformable material.

5. A regulator (2) according to claim 2, wherein in that the hook (17) is made of stainless steel.

6. Apparatus according to claim 1 wherein said inlet and outlet tubes overlap each other axially, and said fixing means comprises a band for encircling said tubes in the axial area where said tubes axially overlap, with said band situated in the axial area between said annular ridges respectively.

7. Apparatus according to claim 6 wherein said band is fixedly secured to said mouthpiece.

8. Apparatus according to claim 1 wherein one of said tubes is outward of the other, and said band has a variable diameter and said band after being positioned to encircle said tubes has its diameter reduced to tightly engage said outward tube.

9. Apparatus according to claim 8 wherein said inlet tube is elastically deformable, and is able to be constricted tightly onto said outlet tube when said band is engaged therearound.

10. A regulator for an underwater breathing apparatus comprising:

a body having a outlet tube for delivering a breathable mixture to a user;

a replaceable mouthpiece having an inlet tube, said inlet and outlet tubes each having a central axis and a terminal end and first and second engagement means on said terminal ends respectively said first and second engagement means extending transversely of the central axis;

said outlet tube adapted to axially receive said inlet tube, one into the other such that their respective engagement means are axially spaced apart a predetermined distance, and a quick release fixing means for tightly fixing said inlet tube to said outlet tube by engaging at least one said respective engagement means, said quick release fixing means also permitting said inlet and outlet tubes to be easily released from each other.

* * * * *